US008166680B2

(12) United States Patent
Lee

(10) Patent No.: US 8,166,680 B2
(45) Date of Patent: May 1, 2012

(54) STEAM IRON

(75) Inventor: Chihhwa Lee, Fujian (CN)

(73) Assignee: Tsann Kuen(China) Enterprise Co., Ltd, Xiamen (CN)

( * ) Notice: Subject to any disclaimer, the term of this patent is extended or adjusted under 35 U.S.C. 154(b) by 236 days.

(21) Appl. No.: 12/530,302

(22) PCT Filed: Mar. 21, 2008

(86) PCT No.: PCT/CN2008/000557
§ 371 (c)(1),
(2), (4) Date: Sep. 8, 2009

(87) PCT Pub. No.: WO2008/106871
PCT Pub. Date: Sep. 12, 2008

(65) Prior Publication Data

US 2010/0058626 A1 Mar. 11, 2010

(51) Int. Cl.
*D06F 75/18* (2006.01)
*D06F 75/34* (2006.01)

(52) U.S. Cl. ..... 38/77.8; 38/77.83; 38/90

(58) Field of Classification Search ..... 219/245; 38/90, 74–77.9, 88, 95
See application file for complete search history.

(56) References Cited

U.S. PATENT DOCUMENTS

| | | | | |
|---|---|---|---|---|
| 2,700,236 | A * | 1/1955 | Marvin et al. | 38/77.83 |
| 2,741,044 | A * | 4/1956 | Maykemper | 38/77.5 |
| 2,750,695 | A * | 6/1956 | Swenson | 38/77.81 |
| 4,107,860 | A | 8/1978 | Coggiola | |
| 4,149,328 | A * | 4/1979 | Hammer et al. | 38/77.83 |
| 6,249,996 | B1 | 6/2001 | Dorber et al. | |

FOREIGN PATENT DOCUMENTS

| | | | |
|---|---|---|---|
| JP | 59203600 | A | 11/1984 |
| JP | 2003230800 | A | 8/2003 |
| JP | 2004173746 | A | 6/2004 |
| JP | 2006081805 | A | 3/2006 |

* cited by examiner

*Primary Examiner* — Ismael Izaguirre
(74) *Attorney, Agent, or Firm* — Rabin & Berdo, P.C.

(57) ABSTRACT

A steam iron is disclosed. The steam iron at least includes a base, a handle and a mechanical pump, in which the base has a steam generator and a water tank. The handle is connected with the base. The handle has a storage space and a shell surrounding the storage space. The mechanical pump is set in the storage space of the handle. The mechanical pump is connected with the steam generator and the water tank, and the bailing member of the mechanical pump is adjacent to the handle. The invention provides the mechanical pump having the bailing member that has short length and mounted in the handle. Because the bailing member may be hidden in the handle, user can easily press the bailing member without driving up finger to press the bailing member. So, the problem is solved that common steam iron is discommodiously used.

4 Claims, 4 Drawing Sheets

STEAM IRON

TECHNOLOGY FIELD

This invention relates to a steam iron, especially to a steam iron with a bailing member of a mechanical pump can be hidden in a shell of a handle.

BACKGROUND OF THE INVENTION

Referring to FIG. 1, it is a cross-section diagram of the existing steam iron. The steam iron 100 includes a base 110, a handle 120 and the mechanical pump 130, in which the base 110 has a steam generator 112 and a water tank 114. A handle 120 is connected to the base 110, the mechanical pump 130 is set between the handle 120 and the base 110, in which the mechanical pump 130 is connected to the steam generator 112 and the water tank 114, the mechanical pump 130 is used to transport the water from the water tank 114 to the steam generator 112 to generate steam.

However, there are still some inconvenience exists in such steam iron 100, for example, the bailing member 132 of the mechanical pump 130 protrudes from the top of the handle 120 a distance, this leads to that user must drive up finger to press the bailing member 132 when user grasps the handle 120 in the ironing process so the actual use is not very smoothly. In addition, the bailing member 132 protruding from the top of the handle 120, this leads to that the steam iron 100 is not streamline, so the existing steam iron 100 does not satisfy the actual needs of current users.

SUMMARY OF THE INVENTION

The present invention is to provide a steam iron, which overcomes the problem that it is not smooth to press the bailing member 132 in existing steam iron and satisfies the actual needs of users.

The present invention adopts the following technical solution: a steam iron, at least comprising: a base, a handle and a mechanical pump, in which the base has a steam generator and a water tank. The handle is connected with the base, the handle has a storage space and a shell surrounding the storage space. The mechanical pump is set in the storage space of the handle, the mechanical pump is connected with the steam generator and the water tank, and the bailing member of the mechanical pump is adjacent to the shell of said handle. The present technical solution provides the mechanical pump having the short bailing member and mounted in the handle, because the bailing member of the mechanical pump may be hidden in the handle, user can easily press the bailing member without driving up finger to press the bailing member, thus the problem is solved that common steam iron is discommodiously used The shell of the handle surrounds the mechanical pump.

The bailing member does not go through the shell of said handle.

The bailing member faces to the shell of the handle.

The handle can be a pliable handle.

The pliable handle is made of synthetic rubber.

A movable shell is provided on the surface of the handle, the movable shell is adjacent to the bailing member of the mechanical pump.

The handle can be a rigid handle.

The length of the mechanical pump is between 10 mm to 15 mm.

The diameter of the mechanical pump is between 20 mm to 35 mm.

The bailing member of the mechanical pump is contacted with the shell of said handle.

The steam iron based on the present invention, provides the mechanical pump having the short bailing member, and the bailing member of the mechanical pump may be hidden in the handle, not only the problem that it is not smooth to press the bailing member 132 in existing steam iron is resolved, but also the appearance of the iron shows a sense of streamline. The steam iron based on the present invention, the advantages: the mechanical pump has the short bailing member, although the operating distance of the bailing member of the mechanical pump is reduced, the bailing capability of the pump is not reduced, the bailing member of the mechanical pump may be hidden in the handle, it satisfies the actual needs of current users

BRIEF DESCRIPTION OF THE DRAWINGS

The present invention will be further explained with the drawings and the embodiments.

DESCRIPTION OF THE PREFERRED EMBODIMENTS

Figure 1:
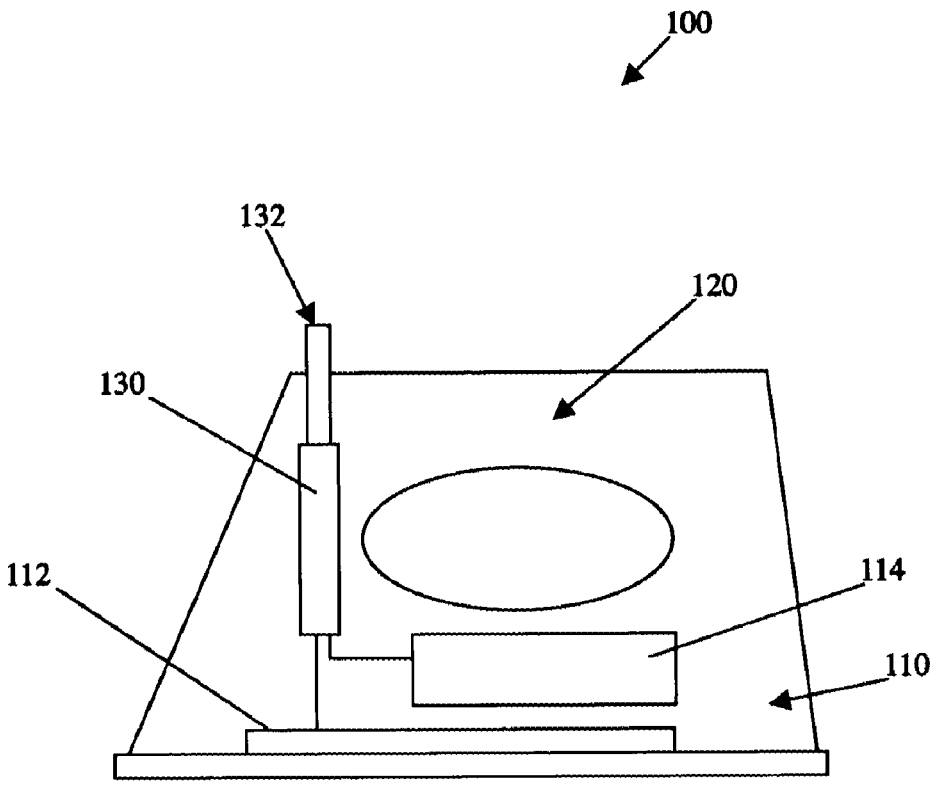
FIG. 1 PRIOR ART
FIG. 1 is a sectional view of the existing steam iron.
Figure 2A:
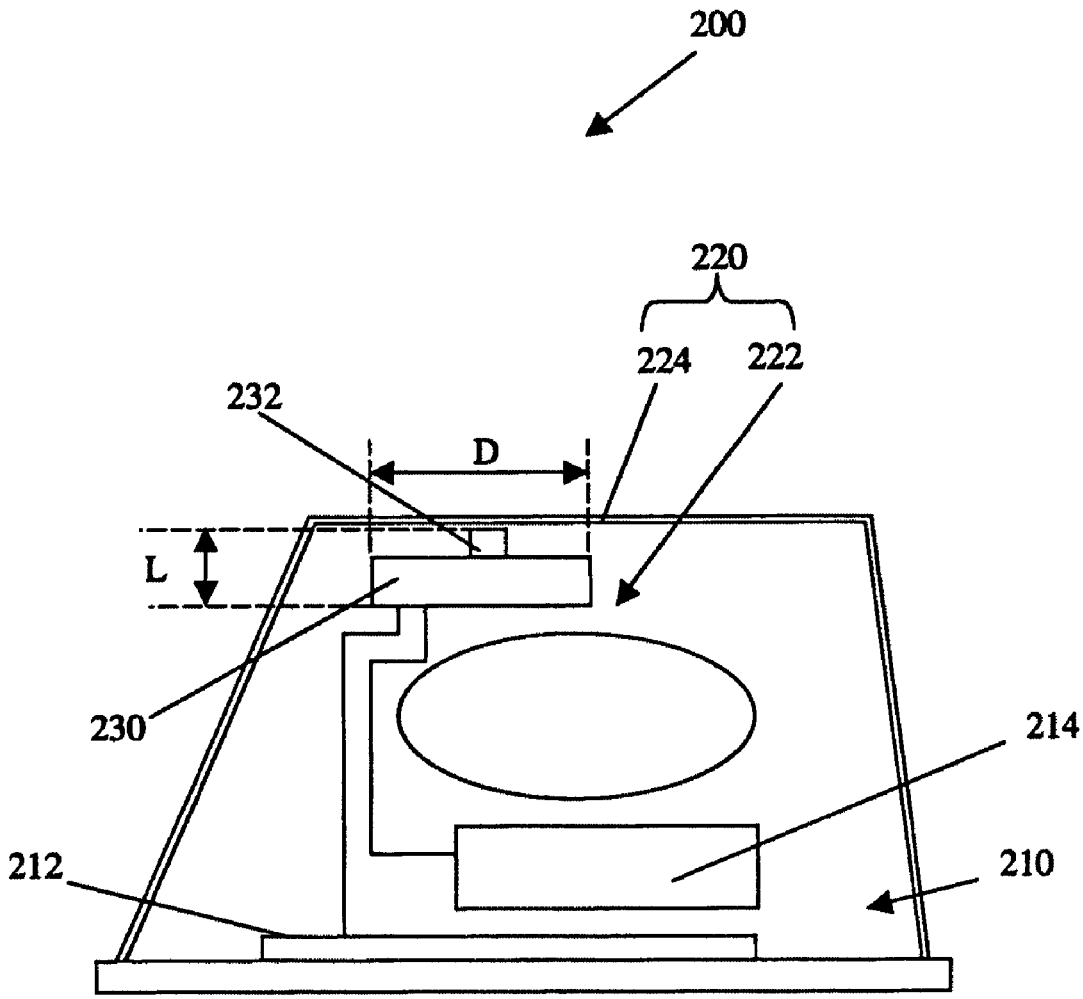
FIG. 2A is a sectional view of the steam iron of one preferred embodiment of the present invention.

Referring to FIG. 2A, it is a sectional view of the steam iron 200 of one preferred embodiment of the present invention. The steam iron 200 comprising: a base 210, a handle 220 and a mechanical pump 230, in which the base 210 has a steam generator 212 and a water tank 214. A handle 220 is connected to the base 210, the handle 220 has a storage space 222 and a shell 224 surrounding the storage space 222. The mechanical pump 230 is set in the storage space 222 of the handle 220, in which the mechanical pump 230 is connected to the steam generator 212 and the water tank 214, the mechanical pump 230 is used to transport the water from the water tank 214 to the steam generator 212 to generate steam In this embodiment, The shell 224 of the handle 220 surrounds the mechanical pump 230, the bailing member 232 of the mechanical pump 230 is adjacent to the shell 224 of said handle and does not go through the shell 224 of said handle. Alternatively, the bailing member 232 of the mechanical pump 230 is contacted with the shell 224 of said handle. In the present invention, the outline of the mechanical pump 230 is changed, the length of the mechanical pump 230 is reduced to the length between 10 mm and 15 mm, the diameter of the mechanical pump is enlarged to the length between 20 mm to 35 mm, this does not lead to the bailing capability of the pump is reduced, and the length of the bailing member 232 of the mechanical pump 230 is shortened, so the bailing member 232 of the mechanical pump 230 may be hidden in the handle 220. In this embodiment, the handle 220 can be a pliable handle, the pliable handle is made of synthetic rubber.

Figure 2B:
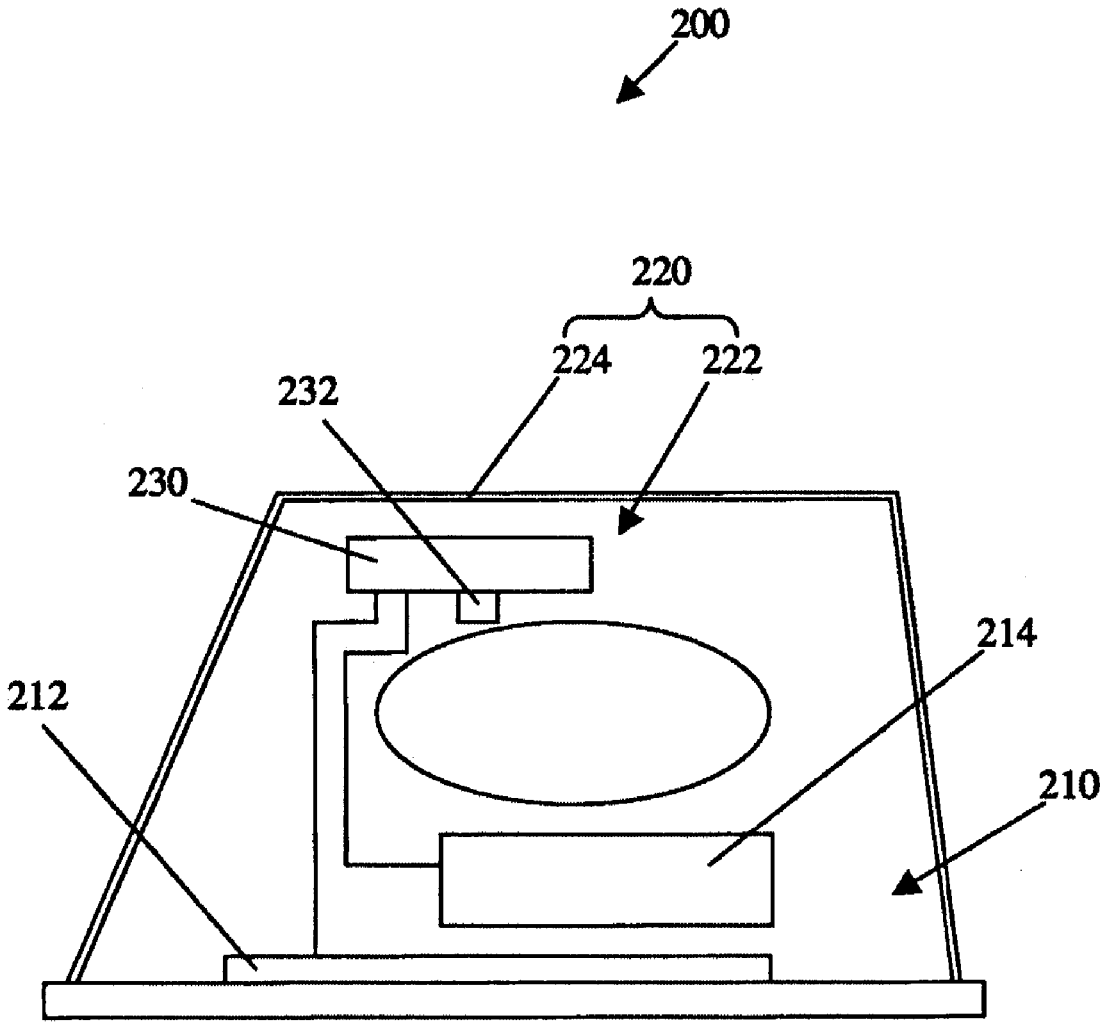
FIG. 2B is a sectional view of the steam iron of another preferred embodiment of the present invention.

In addition, the pliable handle is deformable, when user press the handle 220 positioned above the bailing member 232 of the mechanical pump 230, the handle 220 is deformed, and the bailing member 232 hidden in the handle 220 can be pressed. The bailing member 232 of the mechanical pump 230 can be positioned upwardly as illustration in FIG. 2A, also can be positioned downwardly as illustration in FIG. 2B, but no limit by these, the bailing member 232 of the mechanical pump 230 can be positioned in all directions as long as the bailing member 232 of the mechanical pump 230 faces to the shell 224 of the handle 220.

Figure 3:
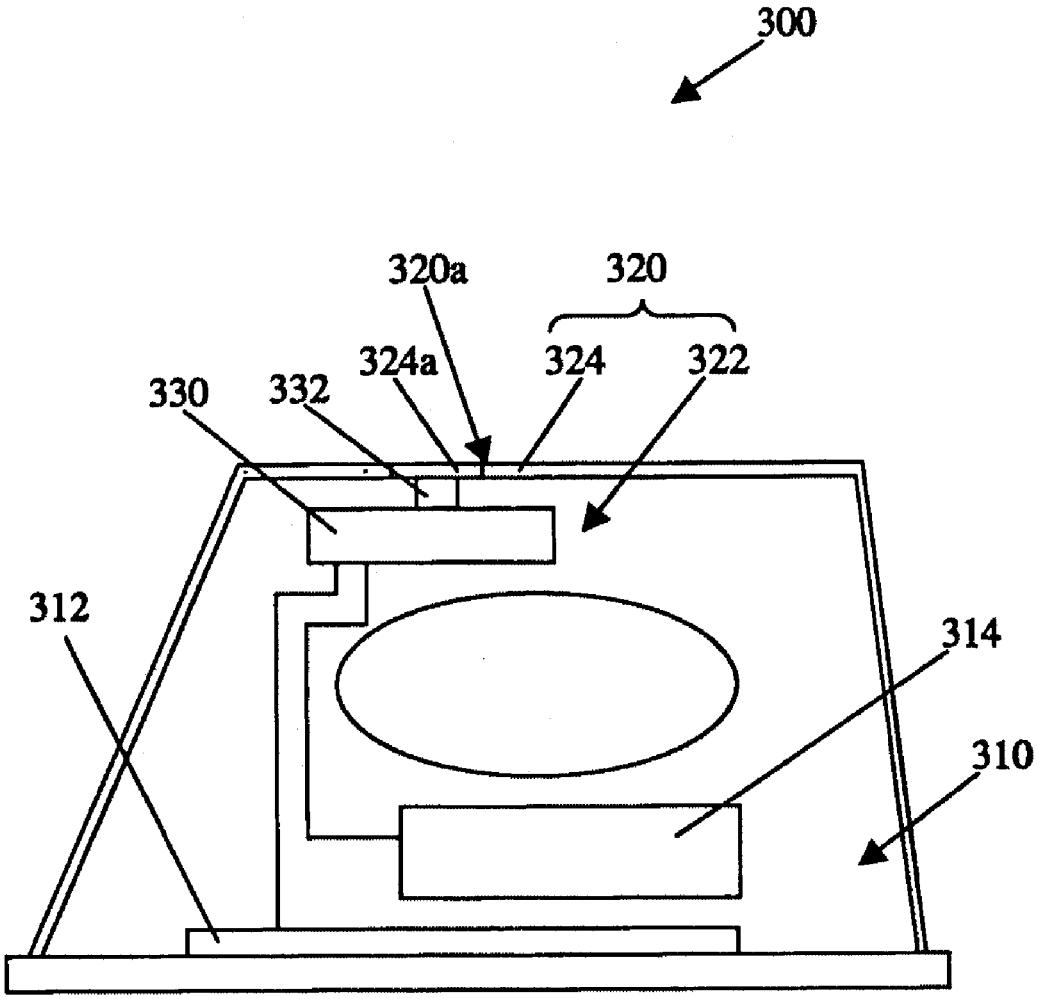
FIG. 3 is a sectional view of the steam iron of the other preferred embodiment of the present invention.

Referring to FIG. 3, it is a sectional view of the steam iron 300 of another preferred embodiment of the present invention. The steam iron 300 comprising: a base 310, a handle 320 and a mechanical pump 330, in which the base 310 has a steam generator 312 and a water tank 314. A handle 320 is connected to the base 310, the handle 320 has a storage space 322 and a shell 324 surrounding the storage space 322. The mechanical pump 330 is set in the storage space 322 of the handle 320, in which the mechanical pump 330 is connected to the steam generator 312 and the water tank 314, the mechanical pump 330 is used to transport the water from the water tank 314 to the steam generator 312 to generate steam. In this embodiment, the shell 324 of the handle 320 surrounds the mechanical pump 330, a movable shell 324*a* is provided on the surface 320*a* of the handle 320, the bailing member 332 of the mechanical pump 330 is adjacent to the movable shell 324*a*. When user press the movable shell 324*a*, the movable shell 324*a* moves downwardly and is contacted with the bailing member 332 of the mechanical pump 330, and the mechanical pump 330 actives the bailing operation. In this embodiment, the handle 320 can be a rigid handle, and is made of PP, but no limit by this, the pliable handle can be used. In addition, the structure of the mechanical pump 330 is similar to the aforementioned embodiment.

As mentioned above, the steam iron based on the present invention, the mechanical pump having the short bailing member is provided, and the bailing member of the mechanical pump may be hidden in the handle, since the bailing member of the mechanical pump may be hidden in the handle, this leads to user can easily press the bailing member without driving up finger to press the bailing member, the problem that it is not smooth to press the bailing member in existing steam iron is resolved. Compared with the existing steam iron, in this invention, the bailing member of the mechanical pump may be hidden in the handle, and the problem that it is not smooth to press the bailing member in existing steam iron is resolved, and the appearance of the iron shows a sense of streamline

INDUSTRY PRACTICABILITY

As known from the preferred embodiments, the steam iron based on the present invention, the advantage is: though the mechanical pump has the short bailing member, the bailing capability of the pump is not reduced, and a bailing member and a mechanical pump can be hidden in the handle of the iron, so the actual needs of current users are satisfied As mentioned above, the described embodiments are to be considered in all respects only as illustrative and no restrictive. All changes which come within the meaning and range of equivalency of the claims are to be embraced with their scope.

The invention claimed is:

1. A steam iron, comprising:

a base containing a steam generator and a water tank;

a pliable handle connected with said base and containing a mechanical pump connected to said steam generator and said water tank, said mechanical pump having a bailing member that is covered by a shell of said handle and is pressable via deformation of the handle.

2. The steam iron according to claim 1, wherein the length of the mechanical pump is between 10 mm to 15 mm.

3. The steam iron according to claim 1, wherein the diameter of the mechanical pump is between 20 mm to 35 mm.

4. The steam iron according to claim 1, wherein the bailing member is in contact with the shell of said handle.

* * * * *